United States Patent [19]

Carver

[11] 4,353,585

[45] Oct. 12, 1982

[54] FISHING TOOL TO RETRIEVE CABLES FROM WELLS

[76] Inventor: Herman C. Carver, 1105A Sequoia, Bakersfield, Calif. 93308

[21] Appl. No.: 193,304

[22] Filed: Oct. 2, 1980

[51] Int. Cl.[3] ..... E21B 31/12

[52] U.S. Cl. ..... 294/86.1; 294/86.2; 294/86.27

[58] Field of Search ..... 294/86.1, 86.12–86.14, 294/86.17–86.21, 86.24–86.29, 86.32, 93, 95, 97, 110 A, 120, 125–130

[56] References Cited

U.S. PATENT DOCUMENTS

| | | | |
|---|---|---|---|
| 776,425 | 11/1904 | Riggs | 294/86.24 |
| 1,033,531 | 7/1912 | Brown | 294/86.27 |
| 1,445,581 | 2/1923 | Fullop | 294/86.2 |
| 1,610,780 | 12/1926 | Hinderliter | 294/86.27 |
| 1,668,254 | 5/1928 | Scott | 294/86.27 |
| 3,029,098 | 4/1962 | Sonnier | 294/86.1 |

*Primary Examiner*—Johnny D. Cherry
*Attorney, Agent, or Firm*—Donald D. Mon

[57] ABSTRACT

A fishing tool to snag and to retrieve cables from wells. The tool includes an elongated body which has two ends, a substantial length, and peripheral boundary of lesser lateral dimensions than a well down which the tool is to be sent with the first of its ends pointed down. A snag member comprises a shank and a snag end on the shank. The shank is mounted to the body so that the snag end faces toward the second of said ends and so that the snag end is movable toward and away from the peripheral boundary. Bias means biases the shank to move the snag end toward the peripheral boundary, and a detent is interposed between the snag member and the body releasably to hold the snag member with its snag end away from the boundary in opposition to the bias force, where it can be released upon contact with an object.

13 Claims, 6 Drawing Figures

FISHING TOOL TO RETRIEVE CABLES FROM WELLS

FIELD OF THE INVENTION

This invention relates to fishing tools for wells.

BACKGROUND OF THE INVENTION

Fishing tools are known to snag and to retrieve cables from wells. The classical technique of such an arrangement is to provide a body with some upwardly-directed hook-like members to move below a cable, and then upward to snag the cable and bring it to the surface. There is a substantial problem involved in the use of this type of fishing tool, which is that if the tool itself goes beyond the bottom end of the oil well pipe or tube, and then the fishing tool is pulled up, the tool can snag on the bottom of the tube and can destroy it, and prevent itself from being extricated. This adds to an already bad problem at the bottom of the well.

It is an object of this invention to provide a fishing tool which can be lowered to snag and retrieve a cable, but which if it catches on the bottom of the well pipe or tubing ("tube" herein) will be triggered so as to retract toward the body of the tool itself where it will no longer constitute an impediment to the withdrawal of the tool from the well.

BRIEF DESCRIPTION OF THE INVENTION

A fishing tool according to this invention comprises an elongated body having two ends, a substantial length, and a peripheral boundary of lesser lateral dimensions than a well down which the tool is to be sent with the first of its ends pointed down. A snag member comprises a shank and a snag end on the shank. The shank is mounted to the body so the snag end faces toward the second of the ends (i.e., upwardly) and so that the snag end is movable toward and away from the peripheral boundary. Bias means biases the shank to move the snag end toward the peripheral boundary, and detent means is interposed between the snag member and the body adapted releasably to hold the snag member with the snag end away from the boundary in opposition to the bias force exerted by the bias means. Upon release of the detent, the bias means will cause the snag end to move toward the boundary in the absence of some other impediment thereto, whereby either to trap a cable if present or to cease to be an impediment to the passage of the tool past the lower end of the tube.

According to a preferred but optional feature of the invention, the snag member is mounted in a slot in the outer periphery of the body behaving as a first class lever, and has an overhanging flange to aid in the entrapment of a cable.

The above and other features of this invention will be fully understood from the following detailed description and the accompanying drawings, in which:

DETAILED DESCRIPTION OF THE INVENTION

Figure 1:
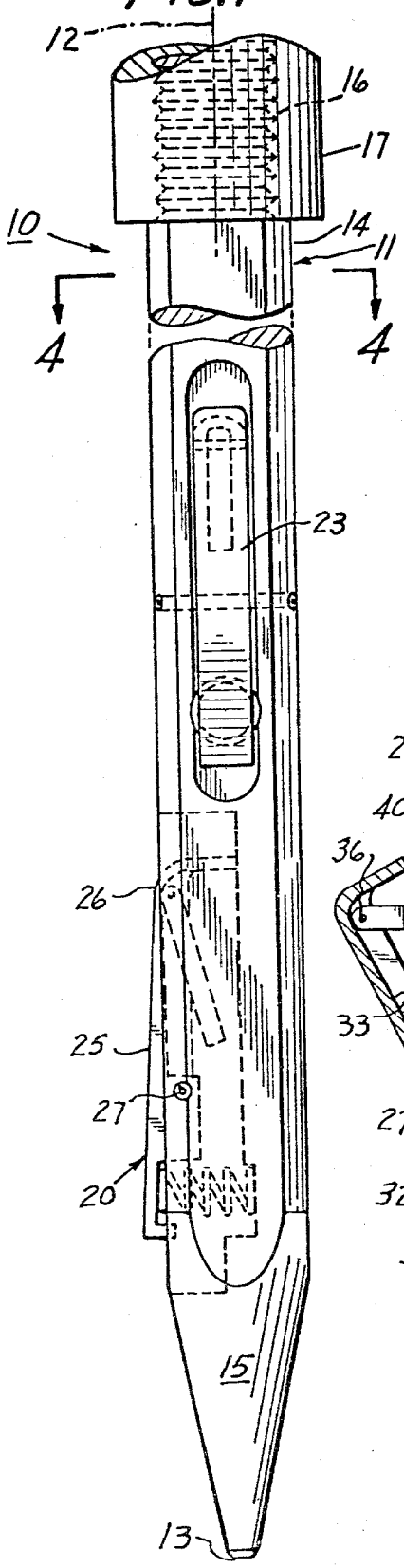
FIG. 1 is a side elevation of the presently preferred embodiment of the invention.

In FIG. 1 there is shown a fishing tool 10 according to the presently preferred embodiment of the invention. It includes an elongated body 11 having an axis 12, a first end 13, and a second end 14. The first end includes a taper 15 to assist the first end in passing through material at the bottom of a well. The second end is provided with a thread 16 for attachment to means (not shown) 17 which enables the tool to be attached either to a pipe or to a cable for being lowered or raised in the well.

A plurality of snag members 20, 21, 22, 23 is shown. These members are angularly spaced apart and preferably are also spaced axially from one another, around and along the axial length of the body. For convenience the body may be made generally square in cross-section. Only snag member 20 will be shown in detail, all of the others being identical to it.

Snag member 20 includes a shank 25 and a snag end 26. Snag end 26 faces toward the second end of the body (i.e., upwardly). Preferably the shank is formed as a first degree lever around a pivot 27. The pivot is conveniently a transverse pin passed through and fitted in the body. Each shank is mounted in a respective slot 28 which extends axially along the outer boundary 29 of the body. Bias means 30 comprises a coil spring seated in a bore 31 in the bottom of the slot and in a recess 32 in the shank. The shank includes a slot 33 to receive a detent 35 which is pivotally mounted in the slot by means of a pivot pin 36. As can best be seen in FIG. 6 the detent can seat inside slot 33. The detent includes a flat end 37 adapted to bear against surface 38 on the body in the bottom slot 28.

Figure 3:
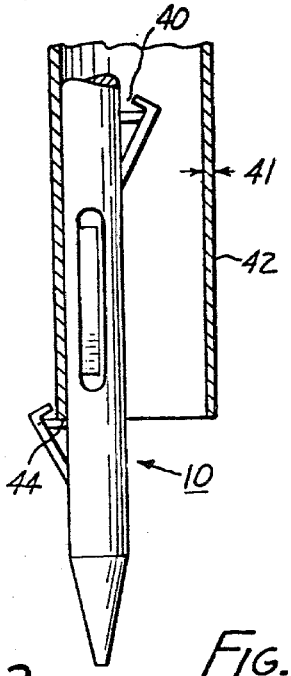
FIG. 3 shows the fishing tool in FIG. 1 in contact with the bottom end of a well tube.

The dimensions of the snag member will be related to the dimensions of the objects which the fishing tool is to work around. For example, as shown in FIG. 3 it is desired for the gap 40 between the snag end and the outer boundary to be somewhat greater than the wall thickness 41 of a well pipe or tube 42 which the snag member might encounter and snap upon. It will also be larger than the diameter of a cable 43 which is intended to be snagged by the fishing tool.

Figure 2:
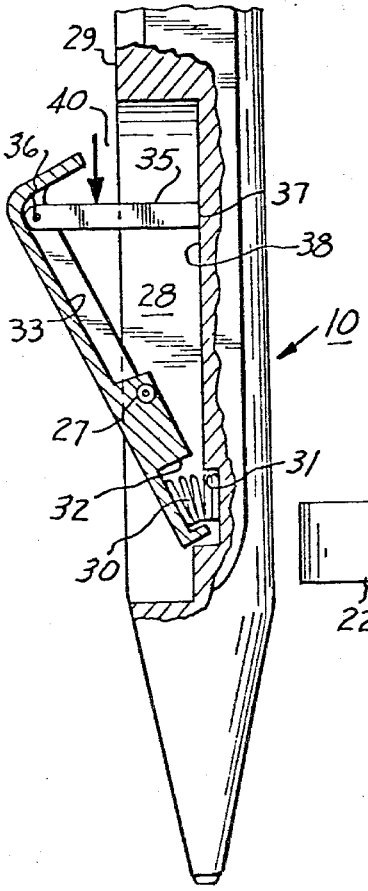
FIG. 2 is an enlarged cutaway portion of FIG. 1.

The function of this device should be evident from the drawings. Before the fishing tool is sent down the well, the snag members are all set like traps, by placing the detent in the position shown in FIG. 2. The detent will hold the snag member open with the snag end pointing upward. The fishing tool will be lowered into the well to below the elevation of the object to be retrieved, and sometimes even below the bottom end of the well tube itself. This latter condition is shown in FIG. 3 where, the fishing tool is again brought up. If the detent arrangement of this invention were not provided, the fishing tool could not be withdrawn from the well because it would be engaged to the bottom end 44 of the tube. However, in this invention, this movement will cause the detent to be moved toward the position shown in FIG. 6. Admittedly, at this time the bottom of the well pipe will be trapped, but the operator will recognize the fact that when he exerts a strong pull on the line which supports the fishing tool and it does not come up, very probably the fishing tool is snagged on the tube. He will then release the line and permit the fishing tool to move down in the pipe so that the snag end clears the bottom of the pipe and the snag member will then snap shut. Then the fishing tool can be pulled up out of the well and be reset, because the snag member will no longer protrude beyond the outer boundary in such a way that it can engage the bottom of the tube.

Figure 5:
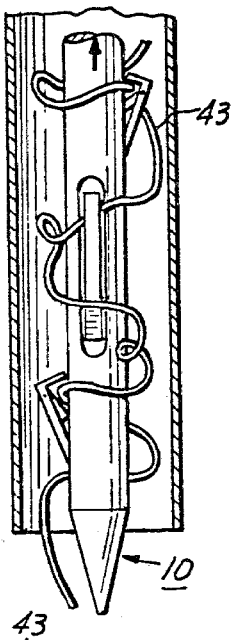
FIG. 5 shows the fishing tool of the invention having snagged a cable in a well.
Figure 6:
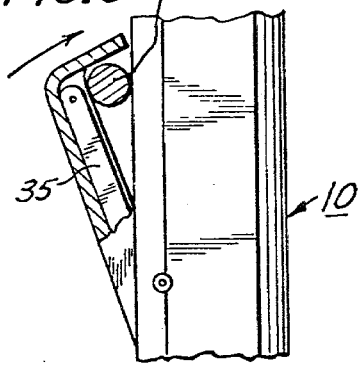
FIG. 6 is an enlarged fragmentary view of a portion of FIG. 5.
Figure 4:
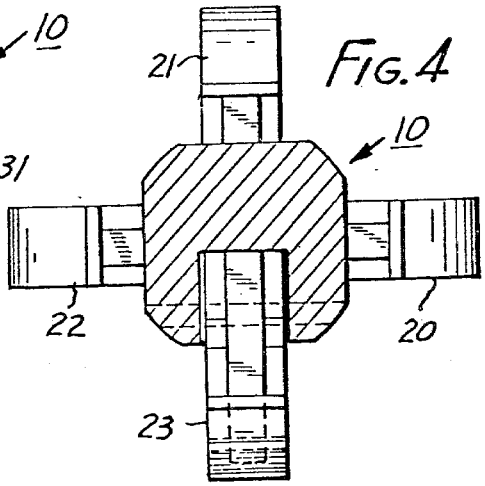
FIG. 4 is a cross-section taken at line 4—4 in FIG. 1.

If, on the other hand a more desirable situation obtains such as shown in FIG. 5, wherein the fishing tool has first been plunged through the mass of cable and then brought up, the cable will pass between the snag end and the outer boundary, and will contact the detent so as to trip it as shown in FIG. 6. If desired, a spring load can be provided to bias the detent toward the position of FIG. 6. The setting of FIG. 2 can be made in opposition to such a spring load although this is usually unnecessary and sometimes is undesirable. In any event, when the detent is moved to the position shown in FIG. 6 the bias will move the snag end toward the boundary. The dimensions have been selected such that the flange on the snag end will overhang the cable, and the cable will be entrapped by the snag member and will be brought to the surface together with whatever is on the end of the cable.

It is evident that instead of a pivoted mounting for the shank, the shank can be a springy finger adapted to spring toward the boundary.

This invention thereby provides an elegantly simple and reliable fishing tool which can snag on to a cable and bring it to the surface, and which can be released from the bottom of a well pipe or tube should it be snagged upon it. It is simple in construction, rugged and reliable in operation.

This invention is not to be limited by the embodiment shown in the drawings and described in the description which is given by way of example and not of limitation, but only in accordance with the scope of the appended claims.

I claim:

1. A fishing tool to snag and retrieve cables from wells, comprising: an elongated body having two ends, a substantial length, and a peripheral boundary of lesser lateral dimensions than a well down which the tool is to be sent with a first of its ends pointed down; a snag member comprising a shank and a snag end on said shank, said shank being mounted to said body so that said snag end faces toward the second of said ends and so that said snag end is movable toward and away from said peripheral boundary; bias means biasing said shank to move said snag end toward said peripheral boundary; and detent means interposed between said snag member and said body adapted to releasably hold said snag member with its snag end away from said boundary in oppostion to the bias force exerted by said bias means, and upon release to permit said bias means to move said snag member to cause said snag end to move toward said boundary in the absence of some other impediment thereto.

2. A fishing tool according to claim 1 in which said shank is pivotally mounted to said body, and in which said bias means is a spring yieldingly interposed between said shank and said body.

3. A fishing tool according to claim 2 in which said shank is pivotally mounted between its ends so as to form a first class lever, said bias means comprising a compression spring disposed between said shank and said body.

4. A fishing tool according to claim 1 in which an axially-extending slot is formed in said bounardy, and said shank is mounted in said slot.

5. A fishing tool according to claim 4 in which said shank is pivotally mounted between its ends so as to form a first class lever, said bias means comprising a compression spring disposed between said shank and said body.

6. A fishing tool according to claim 1 in which said snag end includes an overhanging flange.

7. A fishing tool according to claim 1 in which said detent means is an arm pivotally mounted to said shank, and is in one angular position relative to the shank adapted to abut said body and hold said shank in a position with said shank end spaced from the body in opposition to said bias means, said arm being exposed to objects which enter the spacing between said snag end and said body to trip said detent means and enable said shank and snag end to be moved toward said body to trap said object.

8. A fishing tool according to claim 7 in which said snag end includes an overhanging flange.

9. A fishing tool according to claim 8 in which said shank is pivotally mounted between its ends so as to form a first class lever, said bias means comprising a compression spring disposed between said shank and said body.

10. A fishing tool according to claim 9 in which an axially-extending slot is formed in said boundary, and said shank is mounted in said slot.

11. A fishing tool according to claim 7 in which said first end is tapered.

12. A fishing tool according to claim 1 in which said first end is tapered.

13. A fishing tool according to claim 1 in which said first end is tapered, and there is a plurality of said snag members mounted around the periphery of said body.

* * * * *